United States Patent [19]

Adrian et al.

[11] Patent Number: 4,658,946

[45] Date of Patent: Apr. 21, 1987

[54] ESCALATOR BALUSTRADE DECKING PROFILE

[75] Inventors: Willy Adrian, Obernkirchen; Martin Mehlert, Liekwegen, both of Fed. Rep. of Germany

[73] Assignee: Otis Elevator Company, Farmington, Conn.

[21] Appl. No.: 805,684

[22] Filed: Dec. 6, 1985

[51] Int. Cl.[4] ..... B66B 23/24

[52] U.S. Cl. ..... 198/337

[58] Field of Search ..... 198/337, 335

[56] References Cited

U.S. PATENT DOCUMENTS 2,028,358 1/1936 Shonnard ..... 198/337

FOREIGN PATENT DOCUMENTS 2104471 8/1982 United Kingdom .
2143194 7/1983 United Kingdom .
2152002 12/1984 United Kingdom .

*Primary Examiner*—Joseph E. Valenza
*Assistant Examiner*—Lyle Kim
*Attorney, Agent, or Firm*—Gerald E. Linden

[57] ABSTRACT

The balustrade decking profile (14), or handrail guide, for an escalator clips, or "self-fastens" to the top edge of a glass balustrade (10), and presents a minimal yet sufficient sliding area to the handrail (12). This is accomplished by folding or molding a single rigid strip of material (20) as disclosed herein. The profile (14) itself and a method of forming it are disclosed.

6 Claims, 2 Drawing Figures

ESCALATOR BALUSTRADE DECKING PROFILE

DESCRIPTION

BACKGROUND OF THE INVENTION

Glass escalator balustrades are notably narrower than the handrail itself. This presents a challenge to the designer to implement a guiderail, or decking profile, for the handrail that is both functional and aesthetic.

DISCLOSURE OF THE INVENTION

According to the invention the balustrade decking profile, or handrail guide, for an escalator clips, or "self-fastens" to the top edge of a glass balustrade, and presents a minimal yet sufficient sliding area to the handrail. The profile is formed by folding or molding a single rigid strip of material as disclosed herein.

Other objects, features, and advantages of the invention will become apparent in light of the following description thereof.

BEST MODE FOR CARRYING OUT THE INVENTION

Figure 1:
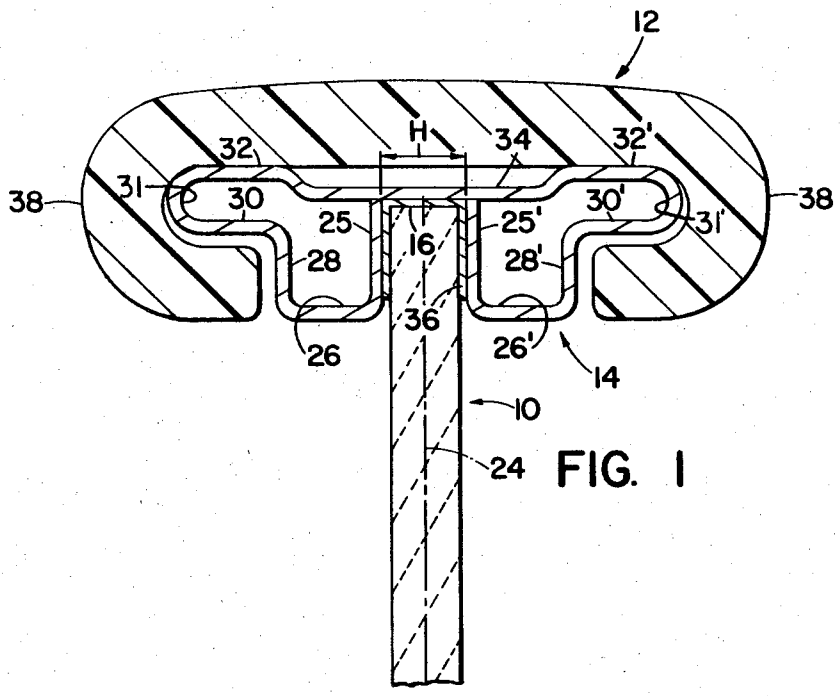
FIG. 1 is a cross-sectional view of the escalator balustrade decking profile of this invention.

FIG. 1 shows the top portion of an escalator balustrade 10 upon which a C-section handrail 12 moves. It is evident that the balustrade 10 is much narrower than the handrail. A guiderail 14 is attached to the top edge 16 of the balustrade 10 to guide and support the handrail 12. The guiderail 14 satisfies the following criteria:

a. It is not visible to the passenger (i.e., from a height above the handrail).

b. It is self-fastening to the balustrade without any discrete fastening devices. (Fastening devices require machining of the glass balustrade.)

c. It presents a minimal, yet sufficient sliding area to the handrail.

Figure 2:
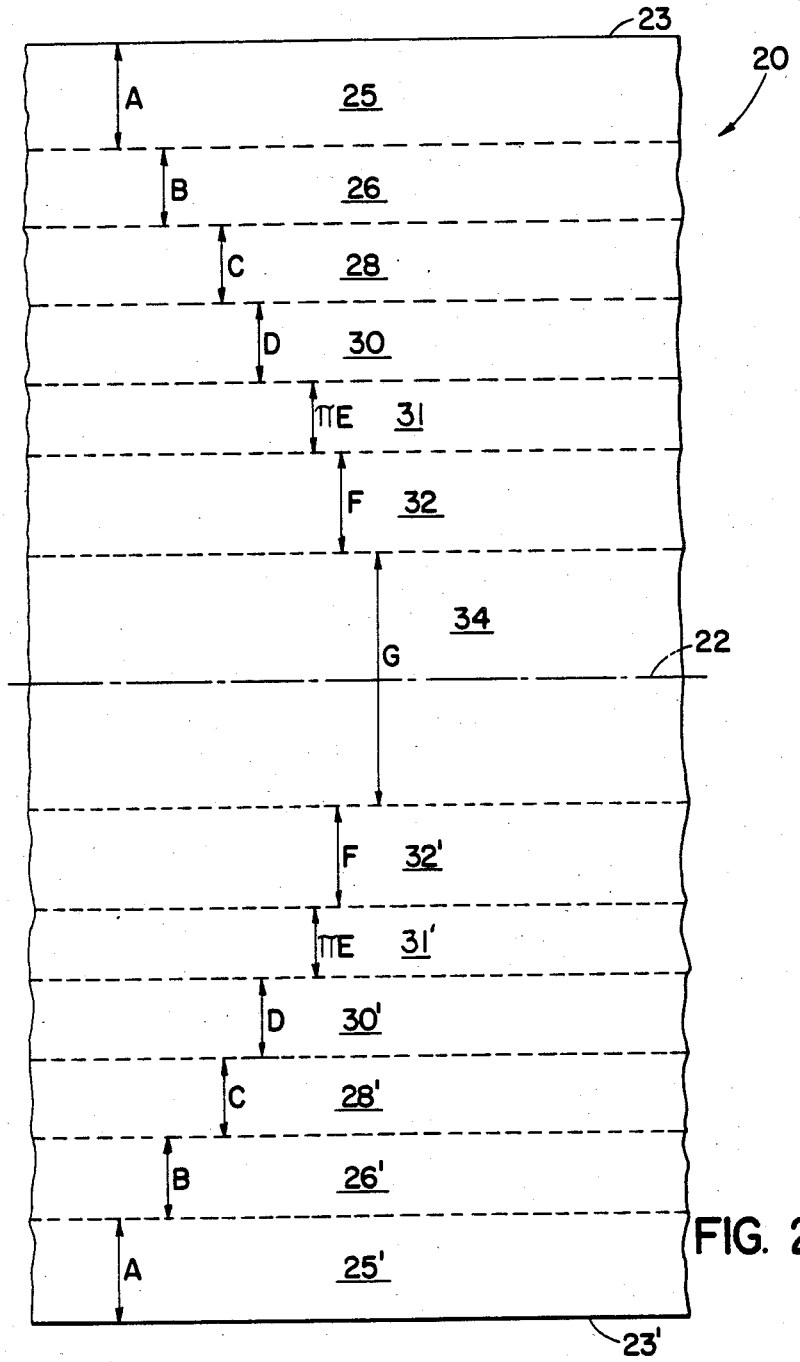
FIG. 2 is a perspective "unfolded" view of the guiderail, detailing its dimensions.

To achieve the aforementioned criteria, the guiderail 14 is fabricated from a long strip of rigid material, such as metal, that is readily bent along longitudinal lines, as follows. FIG. 2 shows such a long strip.

A long strip 20 has a centerline 22 and two edges 23 and 23'. It will become apparent that the ultimate form of the guiderail 14 is symmetrical about the centerline 22, and that the strip centerline 22 is ultimately in line with the balustrade centerline 24 (FIG. 1).

The two edge portions 25, 25' of the strip 20, each having a width A, are bent downwardly at right angles to the plane of the strip.

The two next innermost portions 26, 26' of the strip 20, each having a width B, are bent downwardly at right angles to the plane of the strip.

The two next innermost portions 28, 28' of the strip 20, each having a width C, are bent upwardly at right angles to the plane of the strip.

The two next innermost portions 30, 30' of the strip 20, each having a width D are bent downwardly through 180° to the plane of the strip around a radius E, leaving curved portions 31, 31'.

The two next innermost portions 32, 32' of the strip 20, each having a width F, remain in-plane with the plane of the strip.

The innermost center portion 34 of the strip 20, having a width G, is depressed below the plane of the strip.

Returning to FIG. 1, in the finished article, the centermost portion 34 is depressed below the plane 40 of the strip (20), the next outermost portions 32, 32' are in-plane, the next outermost portions 31, 31' are bent through 180 degrees, the next outermost portions 30, 30' extend substantially parallel to the plane 40 towards the balustrade 10, the next outermost portions 28, 28' extend downwardly, the next outermost portions 26, 26' extend substantially parallel to the plane 40 towards the balustrade 10, and the edgemost portions 25, 25' extend upwardly at right angles to the plane 40.

As is evident from FIG. 1, the two edge portions 24, 24' are ultimately parallel to each other in the guiderail, with a space H therebetween.

Ignoring momentarily the thickness of the strip and the radius of the right angle bends, the following relationships are established.

a. The overall width of the strip 20 is $2A+2B+2C+2D+2\pi E+2F+G$.

b. The space H between the edgemost strip portions 25, 25' is established to clip snugly over the top edge 16 of the balustrade 10, either directly or via a U-shaped buffer basket 36 (FIG. 1).

c. The magnitude of the depression for the center portion 34 is preferably sufficient to contact the edges 23, 23' of the strip.

d. The handrail 12 is in sliding contact with the guiderail over an area related to F (times the length of the guiderail). This minimizes sliding contact between the handrail and the guiderail.

e. The radius E is slightly less than the inner radius of the handrail's curved ends 38, and $2B+H$ is slightly less than the handrail end-to-end gap. Thus, the handrail ends are free-floating.

In the alternative, the guiderail is fabricated from a long strip of plastic which may be molded or extruded to the previously described shape.

It should be understood that various changes may be made to the invention without departing from the spirit and scope thereof.

We claim:

1. An escalator balustrade decking profile (14) for guiding the handrail (12) along the top of a balustrade (10), characterized in that:

the decking profile is made from one long strip (20) of rigid material defining a plane of the strip, having the following portions described sequentially from an innermost portion (34) at the center of the strip, outwardly to edgemost portions (25, 25') at the edges (23, 23') of the strip;

the innermost center portion (34) of the strip is of width G and is depressed below the plane (40) of the strip;

the next outermost portions (32, 32') of the strip are of width F and are in-plane with the plane of the strip;

the next outermost portions (31, 31') of the strip are of width $\pi E$ and are bent downwardly through 180 degrees around a radius E;

the next outermost portions (30, 30') of the strip are of width D and extend substantially parallel to the plane of the strip towards the balustrade (10);

the next outermost portions (28, 28') of the strip are of width C and are bent downwardly at right angles to the plane of the strip;

the next outermost portions (26, 26') of the strip are of width B and extend substantially parallel to the plane of the strip towards the balustrade (10); and the edgemost portions (25, 25') of the strip are of width A and are bent upwardly at right angles to the plane of the strip.

2. The escalator balustrade decking profile of claim 1, characterized in that:

a space of dimension H remains between the edgemost portions (25, 25') of the strip (20); and the dimension H is slightly less than the thickness of the balustrade (10) so that the decking profile (14) clips over the top edge (16) of the balustrade (10) by its edgemost portions (25, 25').

3. The escalator balustrade decking profile of claim 1, characterized in that:

a U-shaped buffer gasket (36) fits over the top edge (16) of the balustrade (10);

a space of dimension H remains between the edgemost portions (25, 25') of the strip (20);

the dimension H is slightly less than the outer dimension of the gasket (36) so that the decking profile (14) clips over the top edge (16) of the balustrade (10) by its edgemost portions (25, 25') via the gasket (36).

4. The escalator balustrade decking profile of claim 1, characterized in that:

the magnitude of the depression in the center portion (34) is sufficient that the center portion contacts the edges (23,23') of the strip (20).

5. The escalator balustrade decking profile of claim 1, characterized in that:

the radius E is slightly less than the inner radius of the handrail's curved ends (38).

6. The escalator balustrade decking profile of claim 1, characterized in that:

a space of dimension H remains between the edgemost portions (25, 25') of the strip; and the sum of the dimensions 2B+H is slightly less than the handrail end-to-end gap.

* * * * *